United States Patent [19]

Donohoe

[11] 4,190,280

[45] Feb. 26, 1980

[54] WHEELED PATIENT SUPPORT

[76] Inventor: Stephen C. Donohoe, 714 S. DuPont St., Wilmington, Del. 19805

[21] Appl. No.: 942,338

[22] Filed: Sep. 14, 1978

[51] Int. Cl.[2] ..... A61G 1/02

[52] U.S. Cl. ..... 296/20; 5/507; 280/32.7; 280/640; 280/767

[58] Field of Search ..... 280/767, 166, 640, 79.1 R, 280/32.5, 32.7, 87.04 B, 87.01, 87.02, 87.04 R, 203, 760; 296/20, 19; 5/92, 81 R, 82 R

[56] References Cited

U.S. PATENT DOCUMENTS

| | | | |
|---|---|---|---|
| 2,682,671 | 7/1954 | Favre | 5/92 |
| 2,798,732 | 7/1957 | Craig | 280/32.5 |
| 3,000,645 | 9/1961 | Schmidt | 280/203 |
| 3,452,371 | 7/1969 | Hirsch | 5/81 B |
| 3,485,314 | 12/1969 | Herr | 280/32.7 |
| 3,746,357 | 7/1973 | Haskins | 296/19 |
| 3,834,726 | 9/1974 | Hobza | 280/32.7 |
| 4,097,941 | 7/1978 | Merkel | 296/20 |

FOREIGN PATENT DOCUMENTS

| | | | |
|---|---|---|---|
| 814256 | 9/1951 | Fed. Rep. of Germany | 280/87.04 R |
| 2603787 | 10/1977 | Fed. Rep. of Germany | 5/92 |

*Primary Examiner*—David M. Mitchell
*Attorney, Agent, or Firm*—Connolly and Hutz

[57] ABSTRACT

A wheeled patient support includes a platform secured to the unit laterally beyond the periphery of the unit and substantially below the patient supporting surface with a rolling surface mounted to and beneath the platform so that an attendant can stand on the platform and treat the patient while the patient is being wheeled to the area of treatment.

9 Claims, 4 Drawing Figures

WHEELED PATIENT SUPPORT

BACKGROUND OF INVENTION

This invention relates to improvements in wheeled patient supports such as stretchers. Frequently emergency conditions arise such as a heart attack which requires a patient to be quickly moved to an area of treatment. During these emergency conditions, it is frequently necessary that an attendant provides some treatment while the patient is being moved. Generally this is done by having one or two attendants, standing at the head and/or foot of a cart, wheel the patient on a cart or stretcher with another attendant located at the side of the cart and treating the patient. Since time is of the essence, the cart or stretcher is wheeled as rapidly as possible. Unfortunately, however, it is necessary to take a route which includes obstacles. Thus the attendant located at the side of the patient cannot devote full attention to the patient but must also be concerned with running along side the patient and watching where he is going particularly to avoid hitting obstacles.

SUMMARY OF INVENTION

An object of this invention is to provide an improved wheeled patient support such as a stretcher, cart or bed which includes means to accommodate an attendant so that the attendant can devote full attention to the patient.

A further object of this invention is to provide such a device wherein the attendant accommodating means can be conveniently and inexpensively mounted to the device.

In accordance with this invention a wheeled patient support such as a stretcher, cart, bed or the like includes a platform mounted to the unit laterally beyond the periphery of the unit and substantially below the patient supporting surface with a rolling surface mounted to and beneath the platform so that an attendant can stand on the platform while the patient is being wheeled to an area of treatment.

In a preferred form of this invention the platform is secured to the unit in such a manner that it has a generally horizontal position during use but may be selectively moved to a generally vertical position during non-use.

The platform may be detachably secured to the unit and may include a padded upper surface. The rolling surface of the platform may include a swivel mechanism to accommodate changes in direction when the unit is being wheeled.

THE DRAWINGS

DETAILED DESCRIPTION

Figure 1:
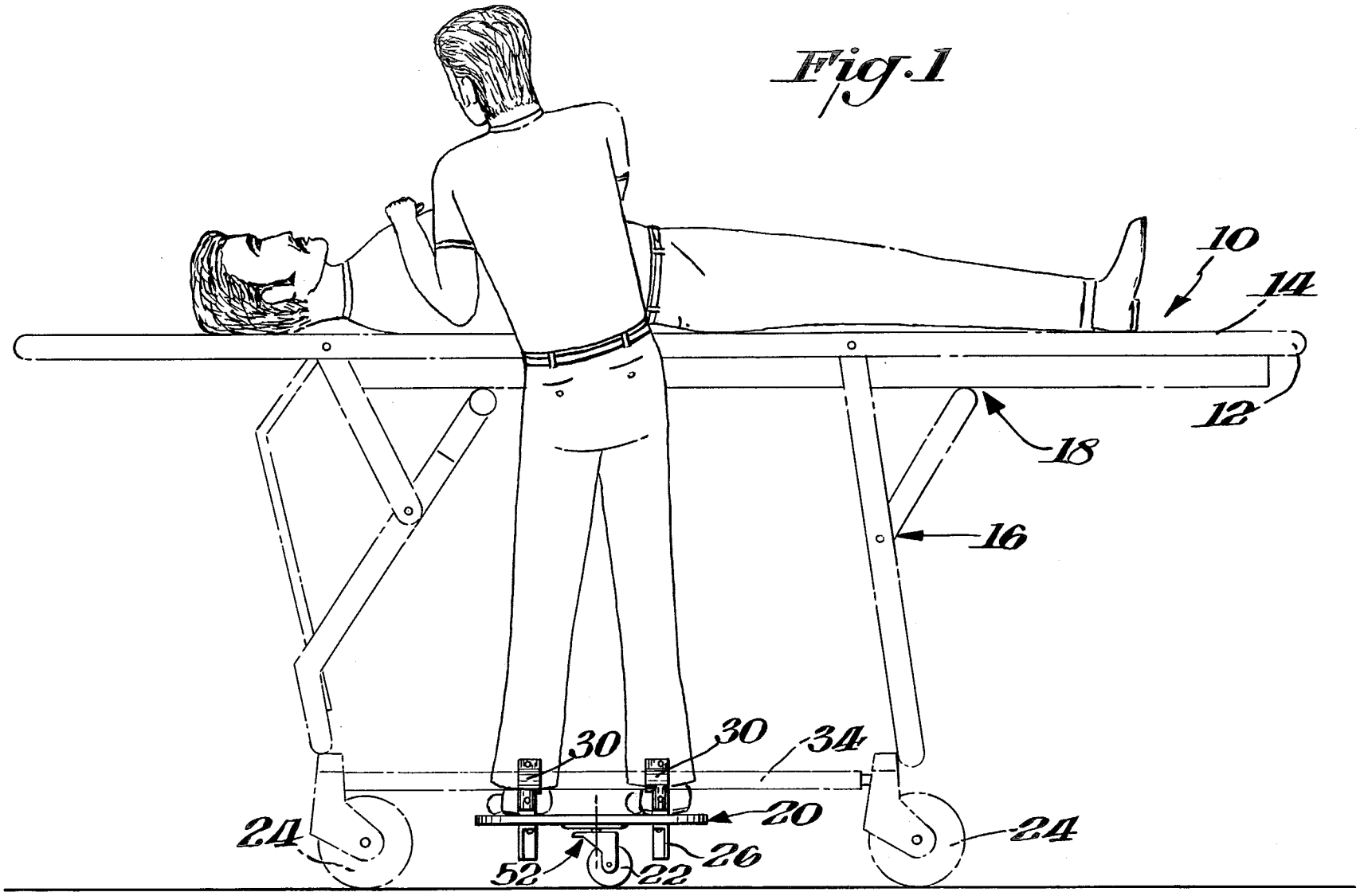
FIG. 1 is a side elevation view of a wheeled patient support in accordance with this invention.

FIG. 1 illustrates a wheeled patient support 10 in accordance with this invention. As indicated therein the patient support includes, for example, spaced rails 12 with a patient supporting surface 14 mounted therebetween and a wheeled structure 16 mounted thereunder to comprise a mobile patient supporting unit 18. The patient supporting unit 18 may take any conventional form and may, for example, be a stretcher or an ambulance cart or even a hospital bed. With such supporting units, the patient supporting area is substantially longer than it is wide and as illustrated in FIG. 1, the patient supporting surface 14 includes a head supporting area and a feet supporting area with a body supporting area therebetween and all of such areas being generally coplanar in a horizontal plane. U.S. Pat. No. 3,980,334, for example, illustrates an ambulance cart which includes a collapsible wheeled structure and exemplifies the type of patient supporting unit which may incorporate the teachings of this invention. Since the details of such stretchers, carts and beds are well-known in the art, further references will not be made thereto except as is necessary for an understanding of this invention.

In accordance with this invention a platform 20 is secured to the mobile patient supporting unit 18 laterally beyond the periphery of the unit and substantially below the patient supporting surface 14. As illustrated in FIG. 1, platform 20 is substantially shorter in length than the length of patient supporting surface 14 with platform 20 being located in the general area of the body supporting area of surface 14. A rolling surface or wheel 22 is mounted to and beneath platform 20 in the same plane as the rolling surfaces 24 of wheeled structure 16. Thus as shown in FIG. 1, an attendant may stand on platform 20 and treat the patient while the support 10 is being wheeled to an area of treatment. This is particularly important during conditions of emergency or the like where it is desirable that the attendant devote full attention to the patient.

The manner of mounting platform 20 to unit 18 and the specific location thereof is so selected that the platform is as close to the ground as convenient so that the attendant may assume a natural or more comfortable position while standing on the platform and while the patient is being wheeled. It is, however, within the concepts of this invention under certain conditions to utilize the platform as a seat for the attendant by mounting the platform at a higher elevation.

In accordance with a preferred form of this invention the platform 20 is disposed in a generally horizontal position generally parallel to the patient supporting surface 14 during periods of use and selectively disposed in a generally vertical position during periods of non-use. In a further preferred form of this invention, platform 20 is detachably mounted to unit 18.

Figure 2:
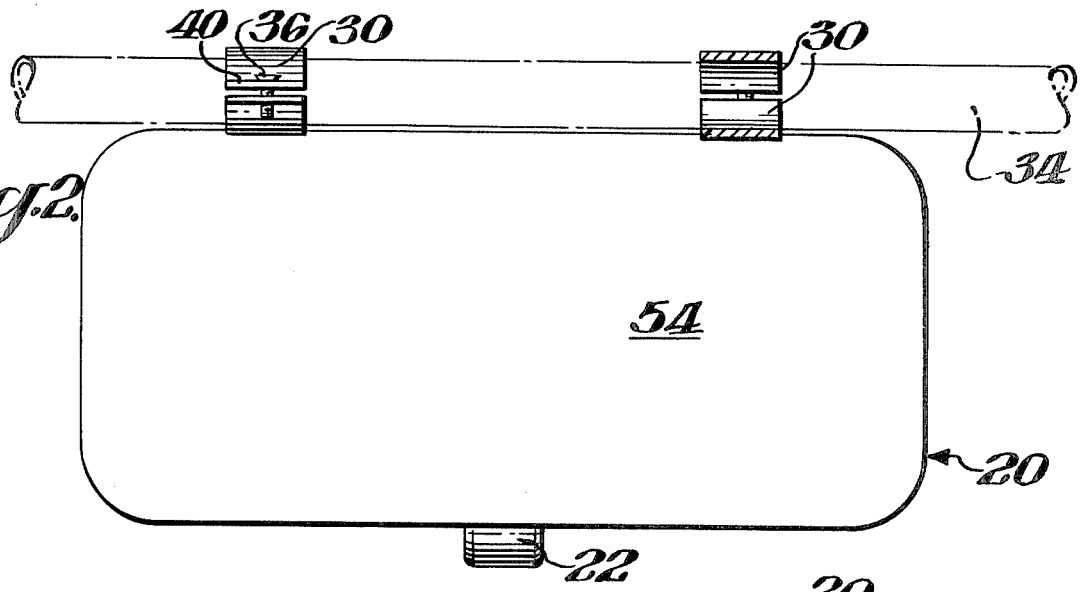
FIG. 2 is a top plan view of the platform incorporated in the invention as shown in FIG. 1.
Figure 3:
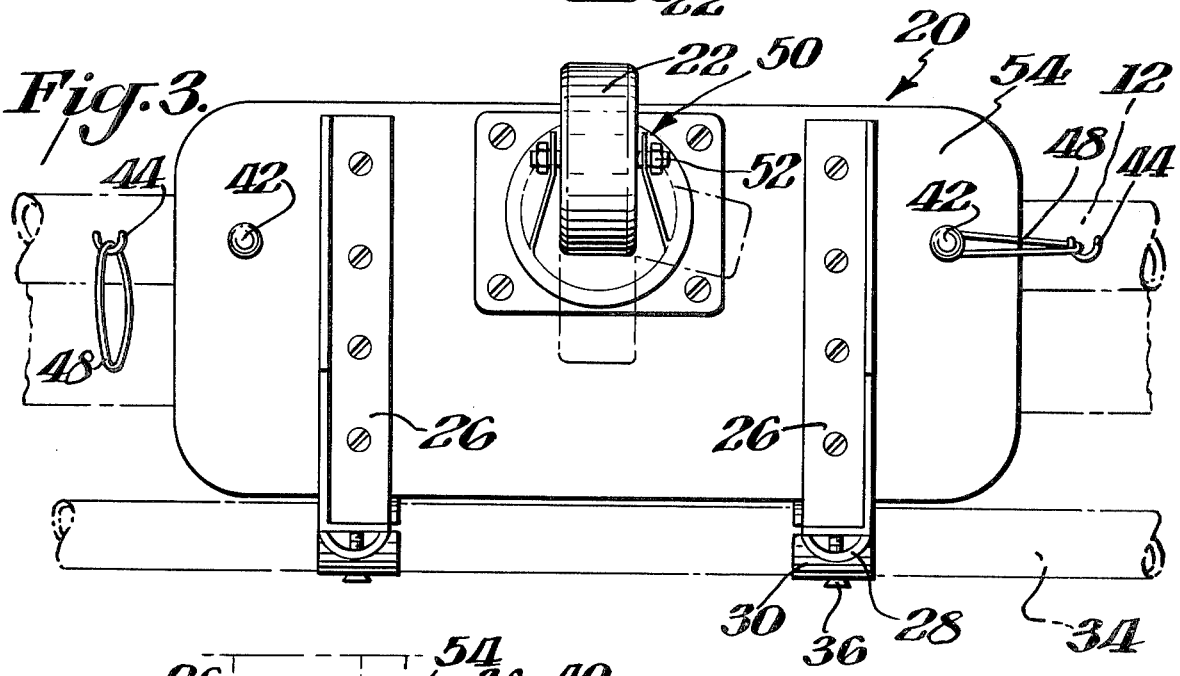
FIG. 3 is a side elevation view of the platform of FIG. 2 elevated to its position of non-use.
Figure 4:
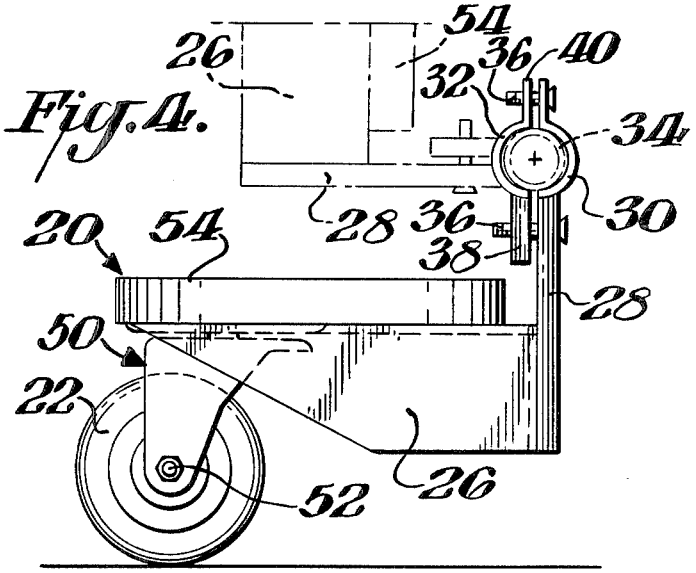
FIG. 4 is a front elevation view of the platform of FIGS. 2–3 shown in solid lines in its position of use and in phantom lines in its position of non-use.

FIGS. 2–4 illustrate one manner of detachably mounting horizontal and vertical positions of use and non-use. As illustrated therein platform 20, which may be made of any suitable material such as vinyl covered plywood, is secured to a pair of support brackets 26 in any suitable manner. Brackets 26 in turn are secured to plates 28, each of which includes a semi-tubular clamp element 30 at the remote end thereof. A complimentary semi-tubular clamp element 32 is also provided whereby clamp elements 30, 32 may be disposed around rail 34 of wheeled structure 16 and firmly clamped by any suitable fasteners such as bolts 36. The actual means of fastening may be accomplished in many ways. For example, extensions 38, 40 of semi-tubular clamp 32 may have threaded bores for engagement with bolts 36 (as shown); or nuts may be provided for bolts 36, and extensions 38, 40 may have smooth bores. By tightening bolts 36 a proper amount, platform 20 may be disposed in the vertical condition illustrated in FIG. 3 during periods of non-use. Where an overly tight clamping effect is not obtained, there would be sufficient frictional engagement to maintain platform 20 in the vertical positions and yet permit it to be rotated to its horizontal position by simply pushing or kicking platform 20 without the necessity of manipulating fasteners 36. If desired, a looser engagement may be had of clamp members 30, 32 on rail 34 and platform 20 may be maintained in its vertical position by any suitable locking means. For example, FIG. 3 illustrates structural elements such as screws or any other post having a head mounted to the undersurface of platform 20. A pair of hooks 44 are secured to rail 46 of wheeled structure 18 and elastic bands 48 are stretched from hooks 44 over posts 42 to thus lock platform 20 in the vertical position.

FIGS. 3–4 also illustrate the inclusion of a swivel mechanism 50 which secures wheel 22 to the bottom of platform 20. Such swivels are known in the art and the details thereof need not be discussed herein. It is noted however that the swivel mechanism permits wheel 22 to rotate about its horizontal axis 52 during positions of use while permitting the wheel assembly itself to rotate about a vertical axis when the direction of movement on the floor is being changed.

As a matter of added convenience, the upper surface 54 of platform 20 is padded so as to be more comfortable for the attendant while he is treating the patient.

As indicated above, the teachings of this invention may be practiced in various manners. Thus different suitable materials and dimensions may be utilized within the scope of this invention. It is noted that the drawings, and more particularly FIGS. 2–4, are drawn to scale. Platform 20 may, for example, have an overall length of $13\frac{3}{4}$ inches and an overall width of $6\frac{1}{4}$ while being $\frac{3}{4}$ inch thick. A 4 inch cannister wheel swivel assembly may be used for the rolling surface. Similarly, clamp elements 30, 32 as well as brackets 26 may be made of aluminum so as to be lightweight although, of course, other materials can be used.

In the practice of this invention when an emergency condition arises which necessitates a patient being quickly moved to an area of treatment, the mobile patient supporting unit 18 is extended from its collapsed condition. The patient is placed on support surface 14 while platform 20 is moved to its position of use. A medical attendant steps on platform 20 where he is disposed in a position for rendering emergency treatment to the patient while the patient is quickly wheeled by another attendant to the area of treatment. During this wheeling, the attendant treating the patient need not be concerned with running along side the unit, nor need he be concerned with small floor obstacles. Moreover, since the attendant is standing on platform 20, he is located a minimal distance away from unit 18 and thus is not as likely to strike obstacles. Accordingly the attendant would be along side of the patient to devote substantially his entire attention to treating the patient while the other attendants need only concern themselves with steering the unit and wheel the patient to the area of treatment as soon as possible.

What is claimed is:

1. In a wheeled patient support having spaced rails with a patient supporting surface mounted therebetween and a wheeled structure mounted thereunder to comprise a mobile patient supporting unit whereby a patient may be placed on the supporting surface and wheeled to an area of treatment during conditions of emergency or the like, the patient supporting surface being substantially longer than it is wide, the patient supporting surface including a head supporting area and a feet supporting area with a body supporting area therebetween and the areas all being generally coplanar in a horizontal plane, the improvement being a platform secured to said unit laterally beyond the periphery of said unit and substantially below said patient supporting surface for supporting a standing attendant thereon, said platform being substantially shorter in length than the length of said patient supporting surface, said platform being located in the general area of said body supporting area, and a rolling surface mounted to and beneath said platform in the same plane as the rolling surfaces of said wheeled structure whereby the attendant may stand on the platform and treat the patient while the patient is being moved to the area of treatment.

2. The patient support of claim 1 wherein said platform is secured to said unit by mounting means for permitting said platform to be selectively disposed in a horizontal position of use generally parallel to said patient supporting surface and in a generally vertical position of non-use.

3. The patient support of claim 2 wherein said mounting means detachably secures said platform to said unit.

4. The patient support of claim 3 wherein said rolling surface includes a wheel having a horizontal axis of rotation when said platform is in said position of use, and swivel means connecting said wheel to said platform whereby said wheel may move about a vertical axis to accommodate different directions of movement of said support.

5. The patient support of claim 3 wherein said mounting means comprises a pair of clamping mechanisms, said wheeled patient support having a lower rail, and said clamping mechanisms being detachably secured to said lower rail.

6. The patient support of claim 4 wherein said unit is a stretcher.

7. The patient support of claim 6 wherein said wheeled structure is collapsible whereby said unit and said platform may be disposed in a generally flat condition during non-use.

8. The patient support of claim 4 wherein said unit is a bed.

9. The patient support of claim 1 wherein the upper surface of said platform is padded.

* * * * *